US006007380A

United States Patent [19]

Shimojyo

[11] Patent Number: 6,007,380

[45] Date of Patent: Dec. 28, 1999

[54] CONNECTOR WITH MOUNTING PLATE

[75] Inventor: Yasuhiro Shimojyo, Isesaki, Japan

[73] Assignee: Hosiden Corporation, Osaka, Japan

[21] Appl. No.: 09/063,401

[22] Filed: Apr. 21, 1998

[30] Foreign Application Priority Data

Apr. 30, 1997 [JP] Japan ..... 9-113059

[51] Int. Cl.[6] ..... H01R 13/648

[52] U.S. Cl. ..... 439/607; 439/939

[58] Field of Search ..... 439/607, 939

[56] References Cited

U.S. PATENT DOCUMENTS 5,288,244 2/1994 Lien ..... 439/607
5,535,080 7/1996 Inoue et al. ..... 439/607
5,772,471 6/1998 Buck ..... 439/939

*Primary Examiner*—Paula Bradley
*Assistant Examiner*—Katrina Davis
*Attorney, Agent, or Firm*—Pollock, Vande Sande & Amernick

[57] ABSTRACT

In a connector 57, its mounting plate 51 comprises a base 27, a press-in portion 53 extending forwardly from the central portion of the base 27 and having a locking hole 52 formed therethrough, and a pair of arms 28 extending forwardly from opposite end portions of the base 27 and then bent downward and having tapped holed 29 formed through the bent portions. The mounting plate 51 is assembled to the connector body 11 by press-inserting thereinto the press-in portion 53 from behind the body 11 and firmly gripping tip end portions 28*a* of the arms between the connector body 11 and a base 23.

5 Claims, 7 Drawing Sheets

FIG. 4B
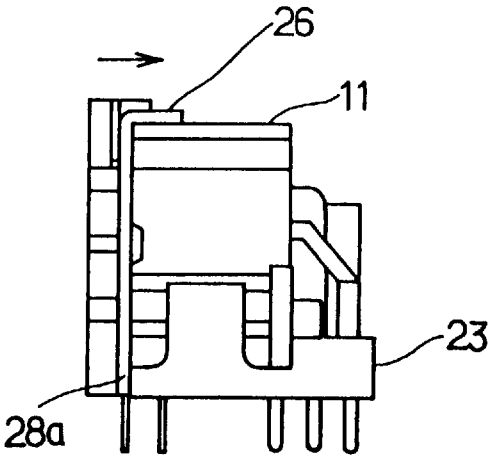
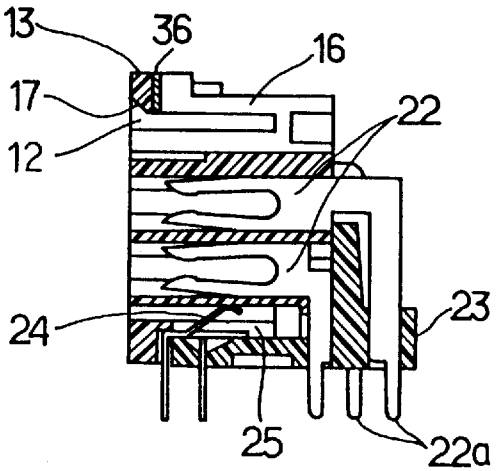
FIG. 4C
FIG. 4A
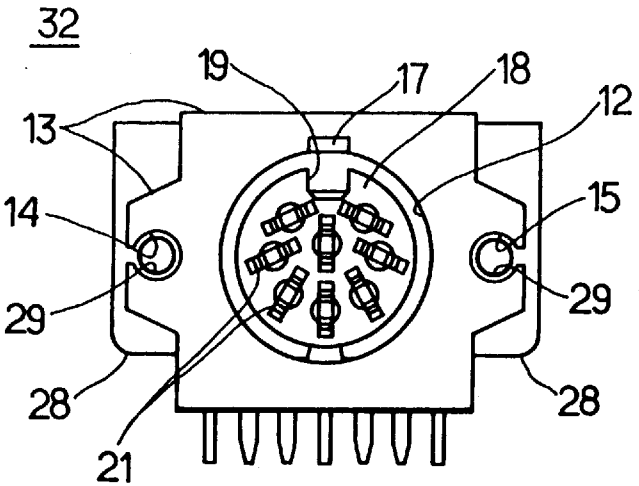

CONNECTOR WITH MOUNTING PLATE

BACKGROUND OF THE INVENTION

The present invention relates to a connector that is provided with a metal mounting plate having tapped holes for mounting the connector, for example, on a chassis and has a locking mechanism.

In FIGS. 4A, 4B and 4C there is depicted the construction of a conventional connector of this kind. The connector has a block-shaped body 11 of an insulating resin material, which has an annular deep groove 12 formed in its front face. The connector body 11 has peripheral flanges 13 laterally directed from right and left marginal edges of its front face. The flanges 13 have mounting holes 14 and 15 formed therethrough diametrically opposite across the annular groove 12. In the upper peripheral wall of the annular groove 12 there is formed a slot-aperture 16 extending rearwardly from the back of the flange 13 and opening into the top of the connector body 11; the slot-aperture 16 receives a lug 35 of a connector (FIG. 6) for locking it in position when it is fitted into the connector. The forward end portion of the slot-aperture 16 is tapered inwardly in the front face of the connector body 11 as indicated by 17. In a cylindrical portion 18 surrounded by the annular groove 12 there is formed opposite the tapered portion 17 a groove 19 extending through the connector body 11.

The cylindrical portion 18 has formed therein a plurality of contact receiving holes 21, in each of which a female contact 22 is held at one end. The female contact 22 is L-shaped, and its other end portion extends down and projects out of the bottom of the connector body 11 through a base 23 of an insulating resin material on the underside thereof, forming a terminal 22*a*. The base 23 has attached thereto a grounding contact piece 24, which resiliently projects in the annular groove 12 through an aperture 25 made in the bottom of the connector body 11.

As depicted in FIGS. 5A, 5B and 5C, the metal mounting plate 26 has a base portion 27 that rests on the top of the connector body 11, and a pair of arms 28 extending forwardly from both ends of the base portion 27 and then bent down. The arms 28 each have a tapped hole formed therethrough and a lug 31 protrusively provided on the inside surface thereof. The arms 28 have their lower end portions narrowed.

The mounting plate 26 is assembled with the connector body 11 by inserting thereinto the former from above so that the arms 28 bear against the back of the flange 13 at the right and left sides thereof. As a result, the tapped holes of the arms 28 are placed in alignment with the mounting holes 14 and 15 at the rear thereof, respectively. The lugs 31 are pressed to the outside of the connector body 11, and the lower end portions 28*a* of the arms 28 are held between the connector body 11 and the base 23.

With the provision of such a mounting plate 26, the connector can easily be mounted, for example, on a chassis by screw-holding through the tapped holes 29 with the front face of the connector body 11 held in engagement with the inside surface of the chassis.

FIG. 6 is a diagrammatic representation of a plug 33 that is connected to the above-described connector 32. Though not shown, the plug 33 has a plurality of male contacts inside a cylindrical metal cover 34 and a positioning protrusion inside the forward end portion of the metal cover 34 for engagement with the groove 19 of the connector 32. As referred to above, the lug 35 resiliently protrudes beyond the periphery of the metal cover 34 for locking engagement in the slot-aperture 16 of the connector 32.

When the plug 33 is fitted into the connector 32, the metal cover 34 is received in the annular groove 12, and at the same time, the male contacts are received in the contact receiving holes 21. The male contacts make contact with the female contacts 22 and the metal cover 34 contacts the grounding contact piece 24, establishing electrical connections between the plug 33 and the connector 32. The lug 35 of the plug 33 is guided by the tapered portion 17 of the mating surface of the connector 32 into the body 11 thereof, and protrudes outwardly of the slot-aperture 16 so that the rear end of the lug 35 matingly engages the rear side of the flange 13, locking the plug 33 to the connector 32.

The flange 13 is reinforced with a plate of metal 36 at the point of engagement therewith of the lug 35 to protect the flange 13 from breakage by undue stress when the plug 33 happens to be forced out of engagement with the connector 32. The reinforcing plate 36 has a pair of bumps 37 as depicted in FIG. 7, and is pressed into a groove 39 defined in the top of the connector body 11 by a pair of projections 38 disposed opposite across the slot-aperture 16 and the flange 13.

The plug 33 thus locked by the lug 35 to the connector 33 can be unlocked therefrom simply by pressing a push-button 41 of the plug 33. By pressing the push-button 41, the lug 35 is retracted into the metal cover 34, enabling the plug 33 to be pulled out of the connector 32.

The conventional connector 32 of the above construction has a shortcoming that, for example, when it is mounted on a chassis, the mounting plate 26 moves relative to the connector body 11, creating difficulty in securing the connector to the chassis by screws.

That is, while the mounting plate 26 has the tip end portions 28*a* of both its arms 28 gripped between the connector body 11 and the base 23, it has no coupling means other than the lugs 31 that are pressed against the body 11—this fails to provide a rigid connection between the mounting plate 27 and the connector body 11. For example, when screwing starts at the mounting hole 14 at the left-hand side in FIG. 4A, the screw tightening force is applied to the mounting plate 26 in the clockwise direction, turning it accordingly. Hence, the tapped hole 29 of the mounting plate 26 at the right-hand side moves out of alignment with the mounting hole 15 of the connector body 11, presenting difficulty in fastening thereto the mounting plate 26 at the right-hand side.

Further, the mounting plate 26 is not fixed at its base portion 27 to the connector body 11, so that when subjected to a force in the direction indicated by the arrow during screwing, the mounting plate 26 falls or turns backward about the lower ends thereof gripped between the connector body 11 and the base 23. This also introduces difficulty in screw tightening operations.

On the other hand, the molding of the connector body 11 necessitates the use of a sliding die for the formation of the groove 39 that receives the reinforcement plate 36 press-fitted thereinto. This gives rise to the problem of a complex die structure.

Additionally, assembling of the conventional connector is cumbersome since it involves assembling of the mounting plate 26 and the reinforcing plate 36 to the connector body 11.

SUMMARY OF THE INVENTION

It is therefore an object of the present invention to provide a connector with a mounting plate which obviates the abovementioned defects of the prior art and which reduces the number of parts used, lowers the manufacturing cost and allows ease in screwing the connector to a chassis, for instance.

According to the present invention, there is provided a connector which comprises: a connector body made of an insulating material and having an annular groove formed in its front face, peripheral flanges laterally directed from right and left marginal edges of the front face at positions diametrically opposite across the annular groove and a slot-aperture formed in the upper peripheral wall of the annular groove and opening into the top of the connector body at the rear side of the flange; a plurality of contacts received and retained in a columnar portion of the connector body defined by the annular groove; a base made of an insulating material and attached to the underside of the connector body at the rear side of the flange; and a metal mounting plate having a pair of tapped holes positioned behind the mounting holes in alignment therewith and a locking hole positioned in the slot-aperture. The mounting plate comprises: a press-in portion projecting forwardly from the central portion of its base and having the locking hole formed therethrough; and a pair of arms extending forwardly from opposite end portions of the base and then bent downward and having the tapped holes formed in the bent portions therethrough. The press-in portion is press-fitted from behind the rear side of the connector body into a press-in groove formed in communication with the slot-aperture and is retained in the press-in groove. The tip end portions of the pair of arms are firmly gripped between the connector body and the base.

BRIEF DESCRIPTION OF THE DRAWINGS

FIG. 4A is a front view showing a conventional connector with a mounting plate;

FIG. 4B is its side view;

FIG. 4C is its sectional view;

DETAILED DESCRIPTION OF THE PREFERRED EMBODIMENT

Figure 1B:
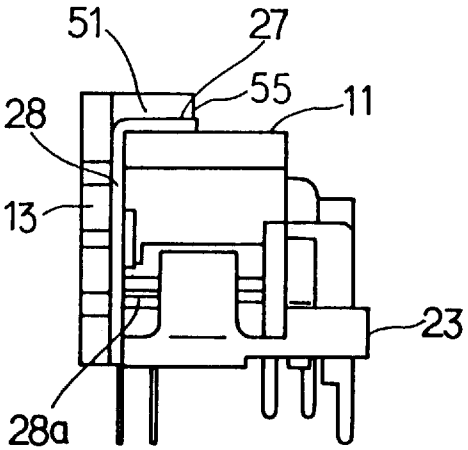
FIG. 1B is its side view.

With reference to the accompanying drawings, an embodiment of the present invention will be described. The parts corresponding to those in FIGS. 4A, 4B and 4C and FIGS. 5A, 5B and 5C are identified by the same reference numerals and no detailed description will be given of them.

Figure 1C:
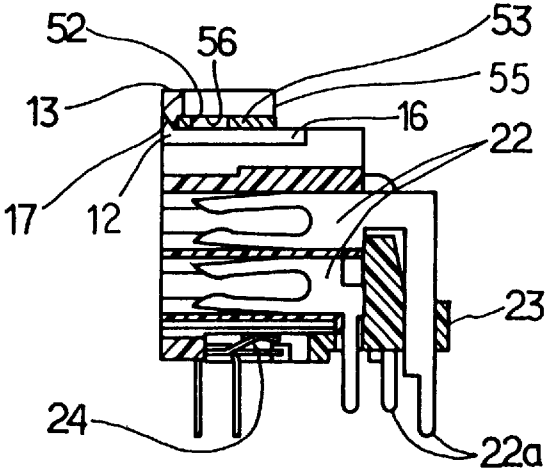
FIG. 1C is its sectional view.
Figure 1A:
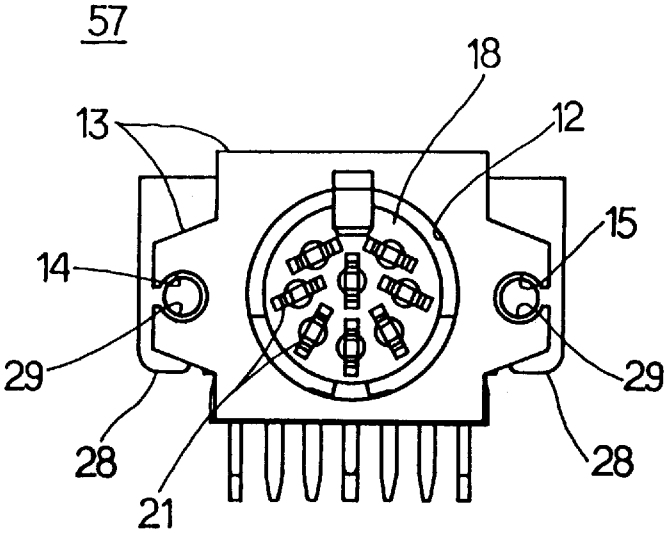
FIG. 1A is a front view illustrating an embodiment of the present invention.

FIGS. 1A, 1B and 1C illustrate an embodiment of the present invention. In the connector body 11 there is formed, as in the case of the FIG. 4 prior art example, the slot-aperture 16 that communicates with the annular groove 12, opens into the top of the connector body 11 and extends rearwardly of the flange 13. In the illustrated example, a mounting plate 51 made of metal is made up of the base 27, the pair of arms 28, and a square tongue-like press-in portion 53 projecting from the central portion of the base 27 in the same direction as that in which the arms 28 project. The pair of arms 28 have a pair of tapped holes 29 that are positioned behind the mounting holes 14 and 15 of the connector body 11. The press-in portion 53 has formed therethrough a square locking hole 52 that lies in the slot-aperture 16 formed in the upper peripheral wall of the annular groove 12 of the connector body 11.

Figure 2A:
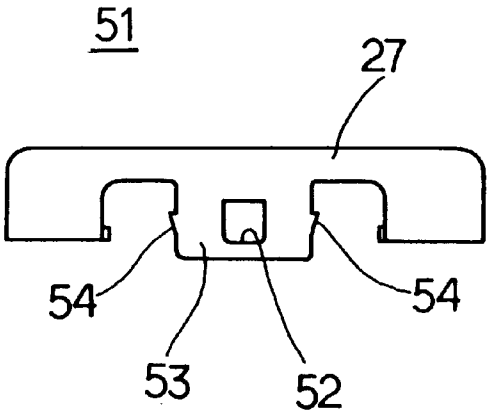
FIG. 2A is a plan view of a mounting plate in FIG. 1.
Figure 2B:
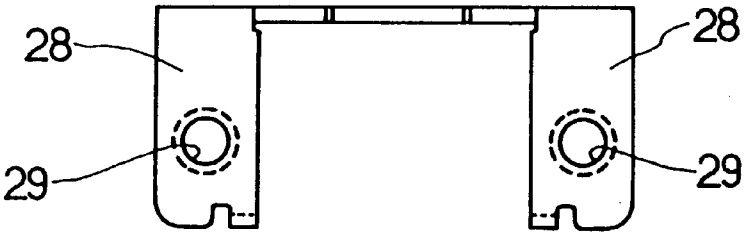
FIG. 2B is its front view.
Figure 2C:
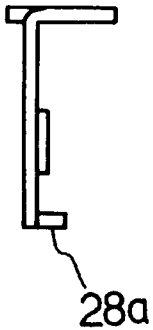
FIG. 2C is its side view.
Figure 3A:
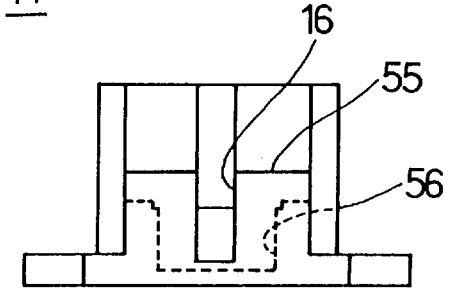
FIG. 3A is a plan view of a connector body in FIG. 1.
Figure 3B:
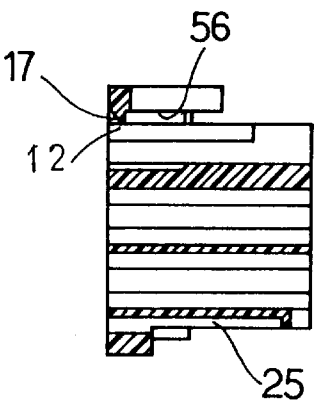
FIG. 3B is its sectional view.
Figure 3C:
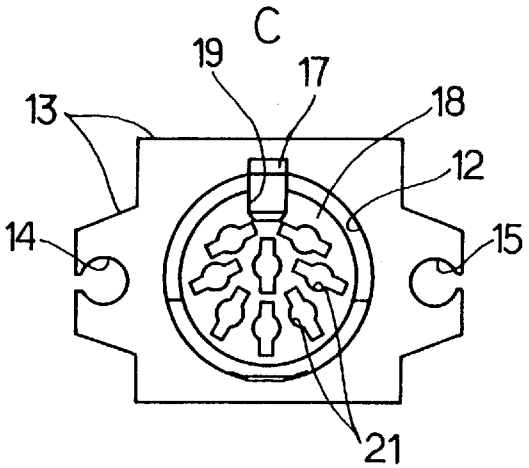
FIG. 3C is its front view.
Figure 3D:
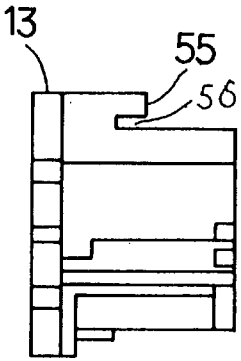
FIG. 3D is its side view.
Figure 3E:
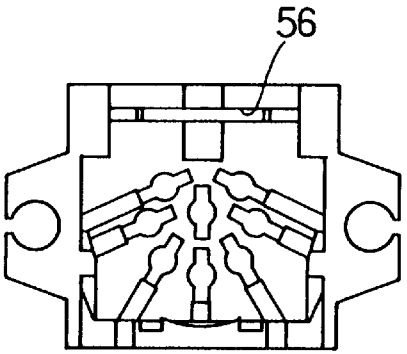
FIG. 3E is its rear view.
Figure 5A:
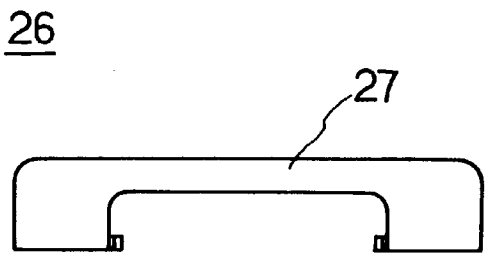
FIG. 5A is a plan view of the mounting plate in FIG. 4.
Figure 5B:
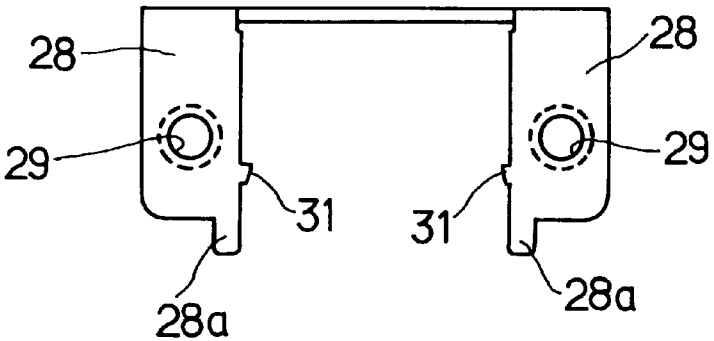
FIG. 5B is its front view.
Figure 5C:
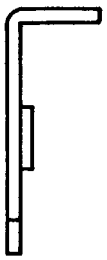
FIG. 5C is its side view.

On both marginal edges of the press-in portion 53 there are protrusively provided lugs 54 on opposite sides of the hole 52. In the illustrated example, the narrow tip end portions 28*a* of the both arms 28 are bent rearwardly as depicted in FIG. 2C.

In the top of the connector body 11 shown in FIGS. 3A through 3E, there provided a shoulder 55 extending across the slot-aperture 16. The top of the connector body 11 extending forwardly of the shoulder 55 is made flush with the top of the flange 13. In the shoulder 55 there is formed a press-in groove 56 that extends across the slot-aperture 16 and forwardly thereof to the rear of the inwardly tapered portion 17 formed in the front face of the connector body 11.

The mounting plate 51 is assembled to the connector body 11 by press-inserting the press-in portion 53 into the press-in groove 56 from behind, by which the locking hole 52 is placed behind the tapered portion 17 as depicted in FIG. 1C and both arms 28 are placed behind the right and left marginal portions of the flange 13 as depicted in FIG. 1B. Then, the base 23 is attached to the connector body 11, thereby gripping the tip end portions 28*a* of both arms 28 between the connector body 11 and the base 23.

Figure 6:
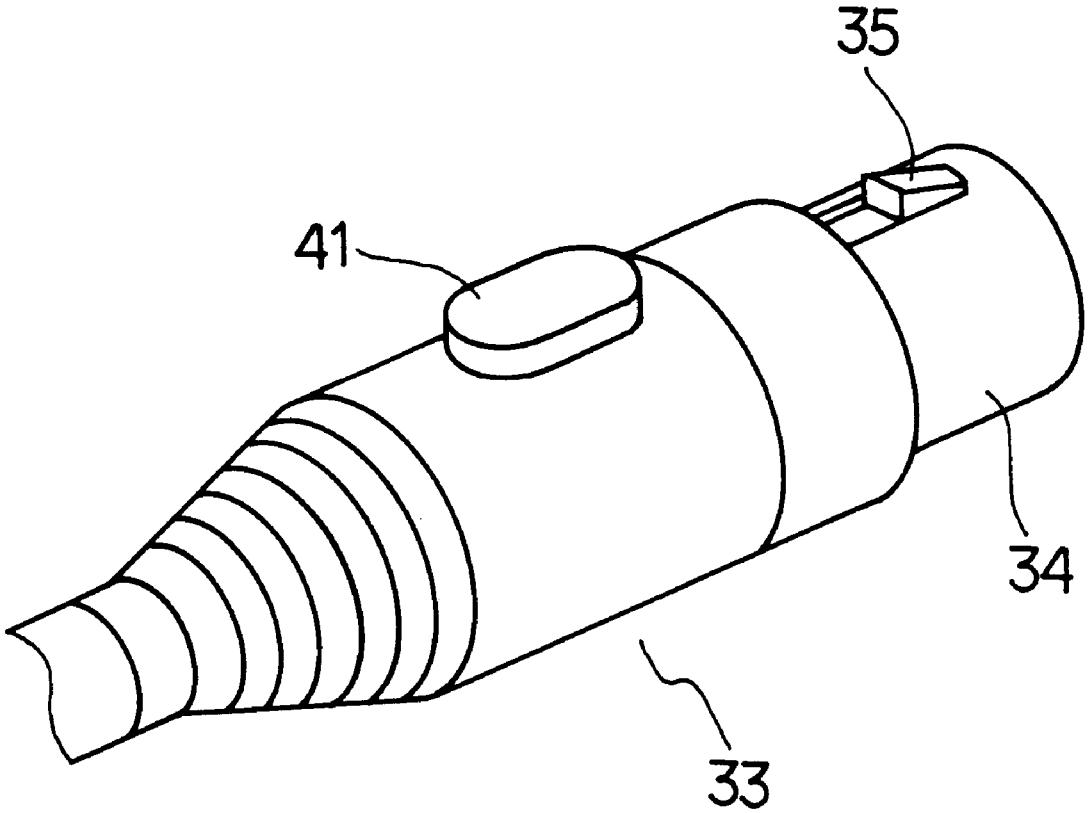
FIG. 6 is a schematic perspective view of a plug for mating with the connector of FIG. 4.
Figure 7:
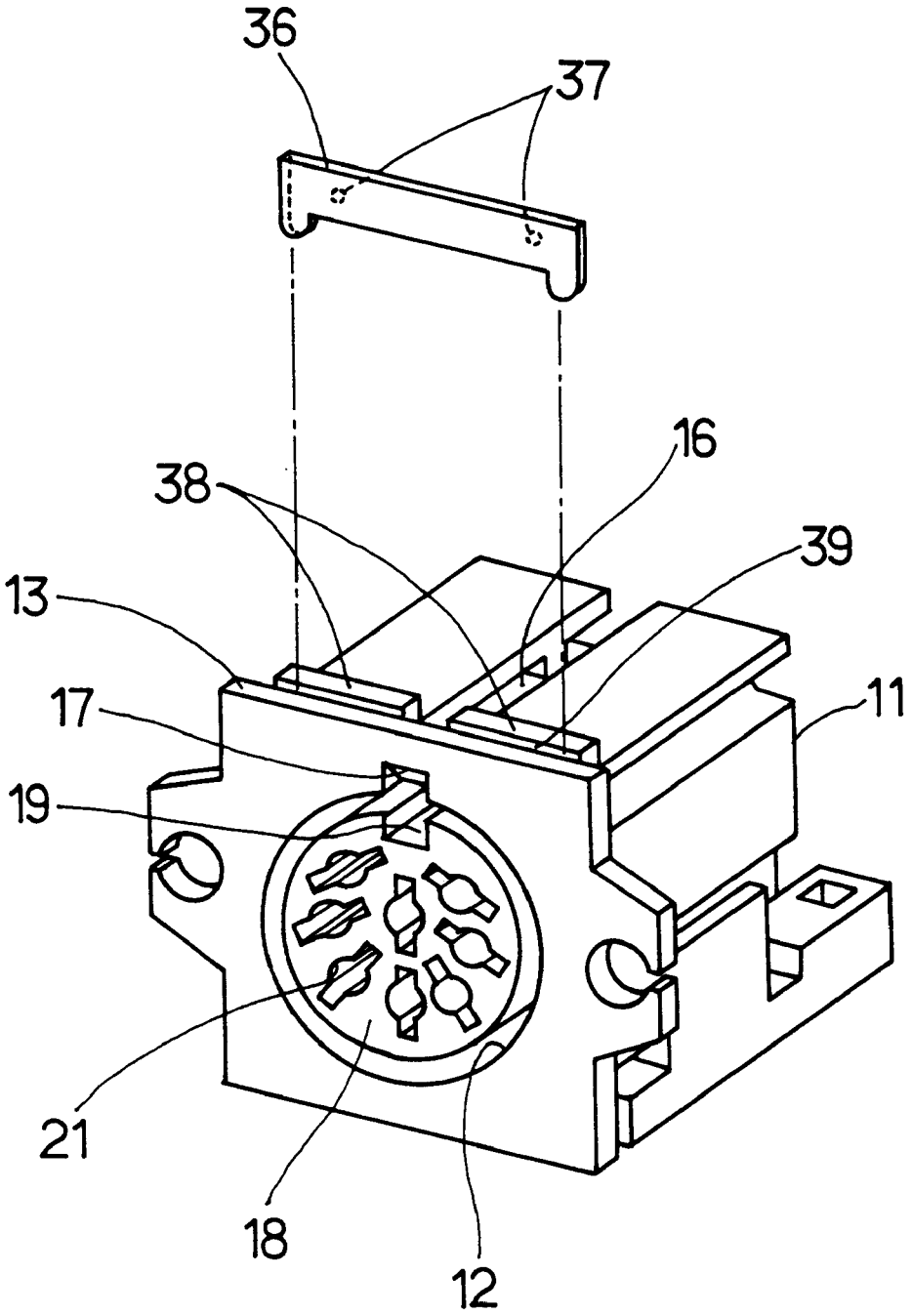
FIG. 7 is a perspective view for explaining the mounting of a reinforcing plate.

With the connector indicated generally by 57 in FIGS. 1A, 1B and 1C, the locking lug 35 of the plug 33 (see FIG. 6) projects outward through the locking hole 52 of the press-in 53 and the rear end of the lug 35 mates with the inside wall of the hole 52 near the forward end thereof, thus locking the plug 33 in place.

Accordingly, even if a large amount of force is exerted on the plug 33 to pull it out of the connector 57, no force is applied to the flange 13; that is, the press-in portion 53 corresponds to the reinforcing plate 36 used in the conventional connector 32 depicted in FIG. 4C.

EFFECT OF THE INVENTION

As described above, according to the present invention, the mounting plate 51 is firmly fixed to the connector body 11 with the press-in portion 53 press-fitted and retained in the groove 56 formed in parallel to the top of the connector body 11 and the tip end portions 28*a* of both arms 28 firmly gripped between the body 11 and the base 23. Thus, for example, when the connector 57 of the present invention is mounted on a chassis, the mounting plate 51 will not turn relative to the connector body 11 during tightening of the screws: hence, the screwing operations can be done with ease.

Furthermore, since the mounting plate 51 has the locking hole 52 that functions also as the conventional reinforcing plate, the number of parts used and the number of assembling steps can be made smaller than in the past—this reduces the cost for fabrication of the connector accordingly.

Incidentally, since the tongue 53 of the mounting plate 51 is press-fitted into the groove 56 from the rear side of the connector body 11, that is, since no sliding die is needed to form the groove 56, the die structure for the connector body 11 is simple—this also serves to cut the manufacturing costs.

It will be apparent that many modifications and variations may be effected without departing from the scope of the novel concepts of the present invention.

What is claimed is:

1. An electrical connector comprising:

a body made of an insulating material and having an annular groove formed in its front face, a peripheral flange laterally directed from right and left marginal edges of said front face at positions diametrically opposite across said annular groove and a slot-aperture formed in an upper peripheral wall of said annular groove and opening into a top of said body at a rear side of said flange;

a plurality of contacts received and retained in a columnar portion defined by said annular groove;

a base made of an insulating material and attached to the underside of said body at the rear side of said flange; and a metal mounting plate having a pair of tapped holes positioned behind mounting holes of the flange and in alignment therewith and a locking hole positioned in said slot-aperture;

wherein said mounting plate includes a press-in portion projecting forwardly from a central portion of its base and having said locking hole formed therethrough; and a pair of arms extending forwardly from opposite end portions of said base and then bent downward and having said tapped holes formed therethrough;

wherein said press-in portion is press-fitted from behind a rear side of said body into a press-in groove formed in communication with said slot-aperture and is retained in said press-in groove; and wherein tip end portions of said pair of arms are firmly gripped between said body and said base.

2. The connector of claim 1, wherein said press-in portion has lugs protrusively provided on both marginal edges thereof for locking engagement with said press-in groove.

3. The connector of claim 1 or 2, wherein said pair of arms have engaging projections extending rearwardly from opposed inner marginal edges of their lower end portions, said engaging projections being firmly held against said body by said base.

4. The connector of claim 1 or 2, wherein a tapered portion is formed in the upper peripheral wall of said annular groove for guiding a locking lug of a plug that is fitted into said connector, and a tip of said press-in portion extends to a rear of said tapered portion.

5. The connector of claim 4, wherein said body has a shoulder formed therein at the rear of said flange and extending down from the top of said body to said slot-aperture and said press-in groove extends forwardly from said shoulder.

* * * * *